United States Patent [19]

Stomma et al.

[11] 4,015,226

[45] Mar. 29, 1977

[54] CARTRIDGE FOR MAGNETICALLY OPERATED CONTACTS

[75] Inventors: Thaddeus Stomma; Edwin J. Wroblewski, both of Milwaukee, Wis.

[73] Assignee: Allen-Bradley Company, Milwaukee, Wis.

[22] Filed: Sept. 4, 1975

[21] Appl. No.: 610,121

[52] U.S. Cl. ..... 335/206; 335/207

[51] Int. Cl.[2] ..... H01H 13/50

[58] Field of Search ..... 335/206, 205, 207

[56] References Cited

UNITED STATES PATENTS

| | | | |
|---|---|---|---|
| 3,403,363 | 9/1968 | Pearse et al. | 335/205 |
| 3,745,493 | 7/1973 | Funke | 335/206 |
| 3,753,179 | 8/1973 | Straub | 335/206 |

*Primary Examiner*—Harold Broome
*Attorney, Agent, or Firm*—Quarles & Brady

[57] ABSTRACT

A pushbutton switch is described in which a pair of contact cartridges containing magnetically operated sealed switches are mounted to an actuator section. The linear motion of the pushbutton is converted to rotary motion by a cam structure mounted in each cartridge and a magnet mounted therein between two switches is thus rotated about a switch axis. By properly polarizing the magnet and by using a magnetic shield, the switches are made to operate as the magnet is rotated to provide a number of possible modes of operation.

8 Claims, 8 Drawing Figures

Fig.4
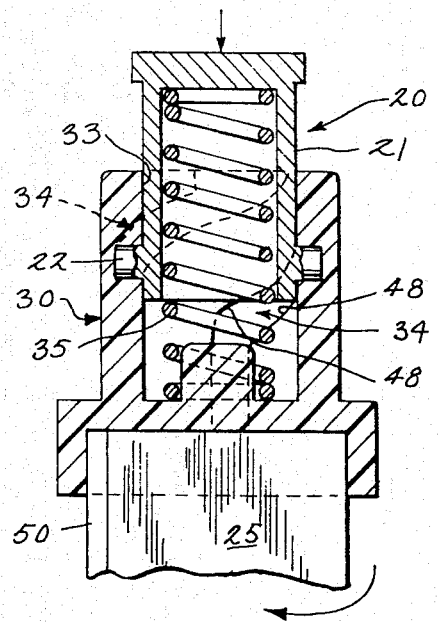
Fig.5a
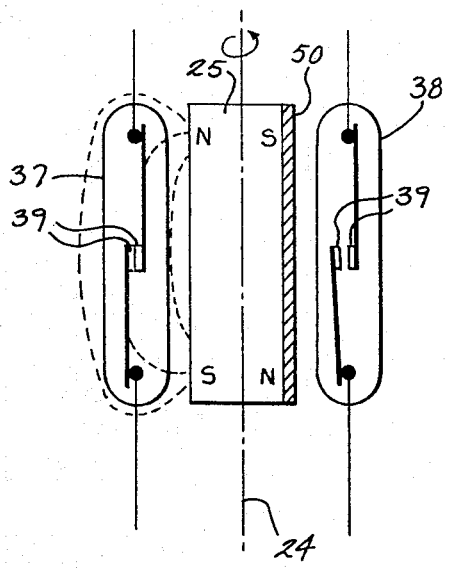
Fig.5b
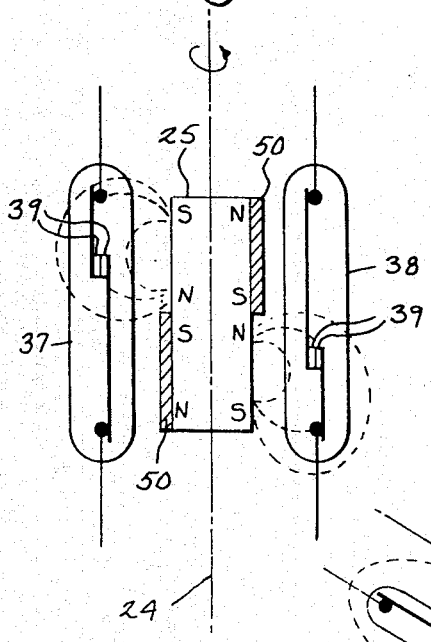
Fig.5c
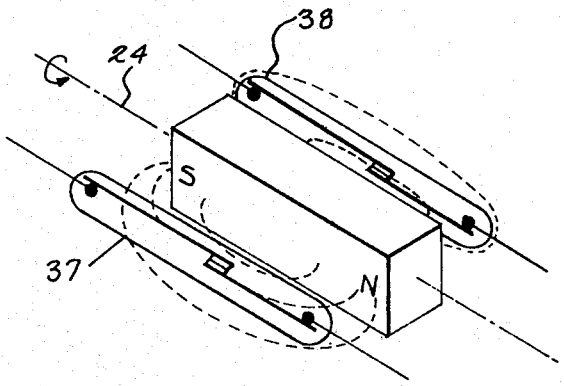
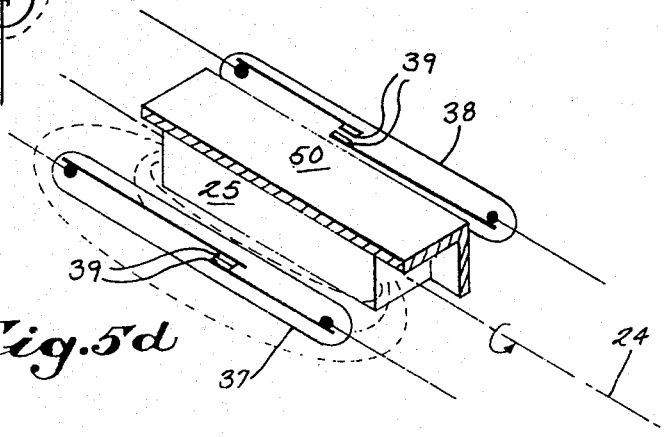
Fig.5d

CARTRIDGE FOR MAGNETICALLY OPERATED CONTACTS

BACKGROUND OF THE INVENTION

The field of the invention is switches having a a button, plunger, or other actuator that is linearly operable to open and close switch contacts. More specifically, the invention relates to the operation of magnetically operable sealed switches by such actuators.

There are numerous commercially available switches for industrial applications in which an actuator section of the pushbutton or rotary selector type is mounted to a contact block section which contains one or more switch cartridges. The switch cartridges are modular in construction so that various types and combinations of switch contacts can be mounted in them and easily fastened to the actuator section. This interchangeability of the switch cartridges requires not only that their outer shape and dimensions conform to the actuator, but also, that their operating characteristics be compatible. The latter requirement has proven to be particularly challenging when magnetically operated switches are contained within the cartridge because the operating stroke on commercially available actuator sections is relatively short.

As disclosed in U.S. Pat. No. 3,745,493 issued to Richard A. Funke on July 10, 1973, one means for magnetically operating sealed switches with a relatively short stroke is to operate the switches off the end of a high energy ferrite magnet which is moved linearly by the actuator section. The magnetic field generated by the magnet is concentrated at its ends and the pickup and dropout points of the switch can be made compatible with the relatively short, linear stroke of the actuator. Another approach is disclosed in U.S. Pat. No. 3,403,363 issued to J. N. Pearse et al on Sept. 24, 1968 in which reed switches are disposed in a plane perpendicular to the operating axis of the switch and the linear motion of the actuator section is converted to rotary motion by a cam arrangement. The cam arrangement rotates a disc shaped magnet disposed in a plane adjacent the reed switches to operate them in a relatively short stroke.

SUMMARY OF THE INVENTION

The present invention relates to a means for actuating magnetically operable sealed switch contacts from a linearly operable actuator element. More specifically, the invention includes cam means for coupling to the actuator section and converting the linear motion of an actuator element along the switch axis to rotary motion about that axis, a magnet coupled to the cam means for rotation about the switch axis, and a set of magnetically operable contacts disposed within an elongated sealed enclosure which is positioned alongside the magnet with its lengthwise axis substantially parallel to the switch axis. The magnet is polarized to generate magnetic flux in the vicinity of the sealed enclosure which varies substantially in magnitude as a function of the angular orientation of the magnet about the switch axis. As a result, when the actuator element is operated, the magnet is rotated about the switch axis and the magnetic flux which it generates through the magnetically operable contacts changes in a prescribed manner to operate the contacts.

The present invention is particularly suited for the use of an oriented ferrite magnet since such magnets can be constructed with a variety of polarizations which generate particularly useful magnetic fields. In addition, however, magnetic shields are fastened to the magnet to rotate therewith and are employed to further shape the magnetic field to produce the prescribed variation in flux density.

A general object of the invention is to magnetically operate sealed switches with an actuator which operates over a fixed linear distance. The cam means includes a cam operator which is coupled for linear movement by the actuator and which cooperates with a cam element fastened to the magnet to impart rotary motion thereto. The extent of the rotary motion is controlled by the slope of the cam surface and for any given actuator stroke it can be shaped to rotate the magnet a desired amount, such as 90° or 180°.

Another object of the invention is to provide a sealed switch cartridge of minimum size. The magnet is relatively long and slender and is oriented with its lengthwise axis along the switch axis. One or more sealed switches are mounted immediately alongside the magnet with their lengthwise dimensions oriented in the same direction. When two sealed switches are mounted on opposite sides of the magnet a relatively flat cartridge results and two of such cartridges can be mounted to a single, conventional switch actuator section.

Another object of the invention is to provide a structure which is easily assembled. The elements are enclosed in a housing comprised of a base and a cover. The elements are all dropped into position within the base and the cover is attached. The structure thus lends itself to mass production techniques.

The foregoing and other objects and advantages of the invention will appear from the following description. In the description reference is made to the accompanying drawings which form a part hereof and in which there is shown by way of illustration a preferred embodiment of the invention. Such embodiment does not necessarily, however, represent the full scope of the invention, and reference is made to the claims herein for interpreting the breadth of the invention.

BRIEF DESCRIPTION OF THE DRAWINGS

FIG. 4 is a plane view with parts cut away of the cam means which forms part of the switch cartridge of FIG. 3, and FIGS. 5*a*–5*d* are schematic diagrams of various magnet and shield configurations which can be used in the switch cartridge of FIG. 3.

DESCRIPTION OF THE PREFERRED EMBODIMENT

Figure 1:
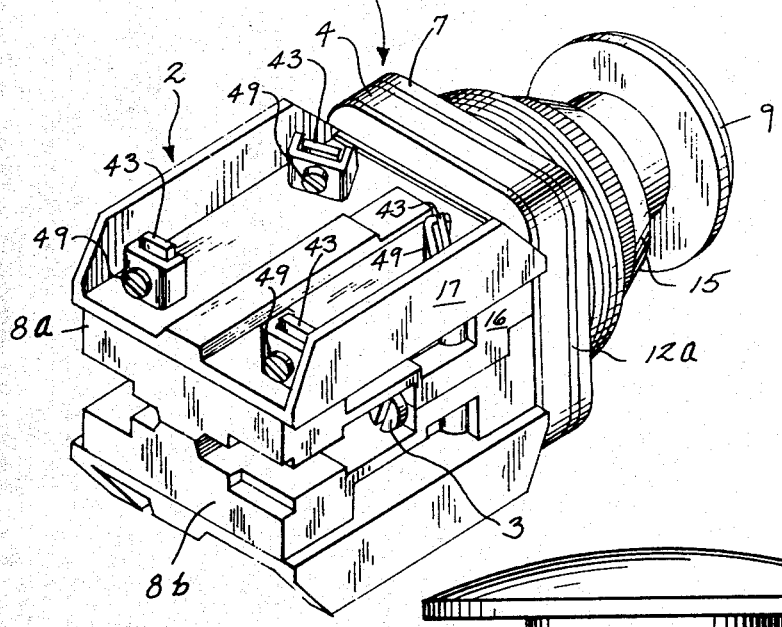
FIG. 1 is a perspective view of a pair of switch cartridges mounted to a switch actuator section.
Figure 2:
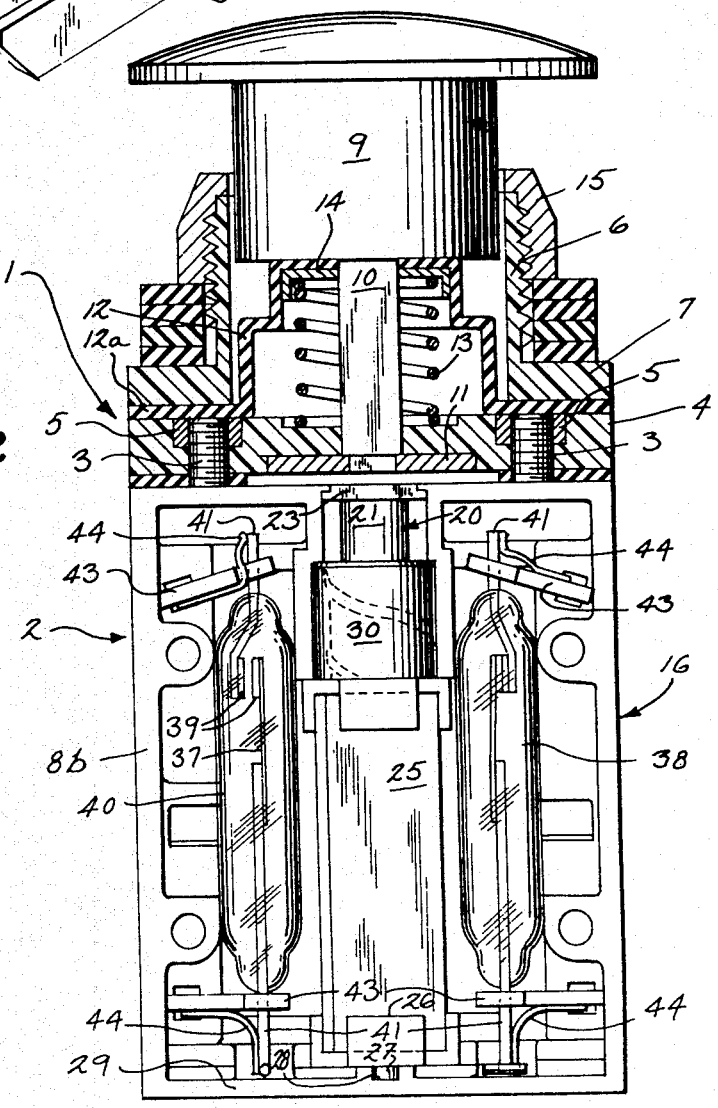
FIG. 2 is a view in cross section taken through the switch of FIG. 1.

Referring particularly to FIGS. 1 and 2, a pushbutton switch suitable for industrial applications is shown and includes an actuator section 1 suitable for mounting to a panel and a contact block section 2 mounted to the rear surface of the actuator section 1 by a pair of bolts 3. The actuator section 1 is of generally conventional construction and includes a square base 4 made of an insulating material and supporting in the upper surface thereof a pair of nuts 5 for the bolts 3. Atop the base 4 is a tubular housing 6 which has a square base flange 7 that is square in shape and coextensive with the base 4. A pushbutton 9 is slidably received in the housing 6 and has an integrally formed plunger 10 which extends downwardly through an opening in the base 4 to terminate therebelow in a cross-shaped actuator element 11. The plunger 10 and the opening therefor in the base 4 are preferably square to prevent rotation of the pushbutton 9 and the attached plunger 10 and actuator element 11.

To prevent the entry of moisture or other contaminants, a seal 12 made of a natural or synthetic rubber is disposed around the plunger 10 and includes a peripheral portion 12*a* which is clamped between the base 4 and the base flange 7. A compression spring 13 is positioned within the sealed cavity around the plunger 10 and operates between the base 4 and an inverted cup 14 to urge the pushbutton 9 upwardly to the position shown in the drawings. The pushbutton 9 with attached plunger 10 and actuator element 11 can be moved downwardly by manually depressing its surface. A retainer ring 15 is threaded on the circular outer surface of the housing 6 to allow the entire switch to be mounted through an opening in a control panel or the like.

Although the actuator section 1 has been shown and described in detail, it forms no part of the invention except insofar as it constitutes an actuator that is reciprocally movable in linear fashion. Other types of pushbuttons could be substituted as could other forms of linear actuators such as selector switch actuators and limit switch actuators of various constructions well known to those skilled in the art. It is necessary to the invention only that there be some type of actuator element with linear movement.

Figure 3:
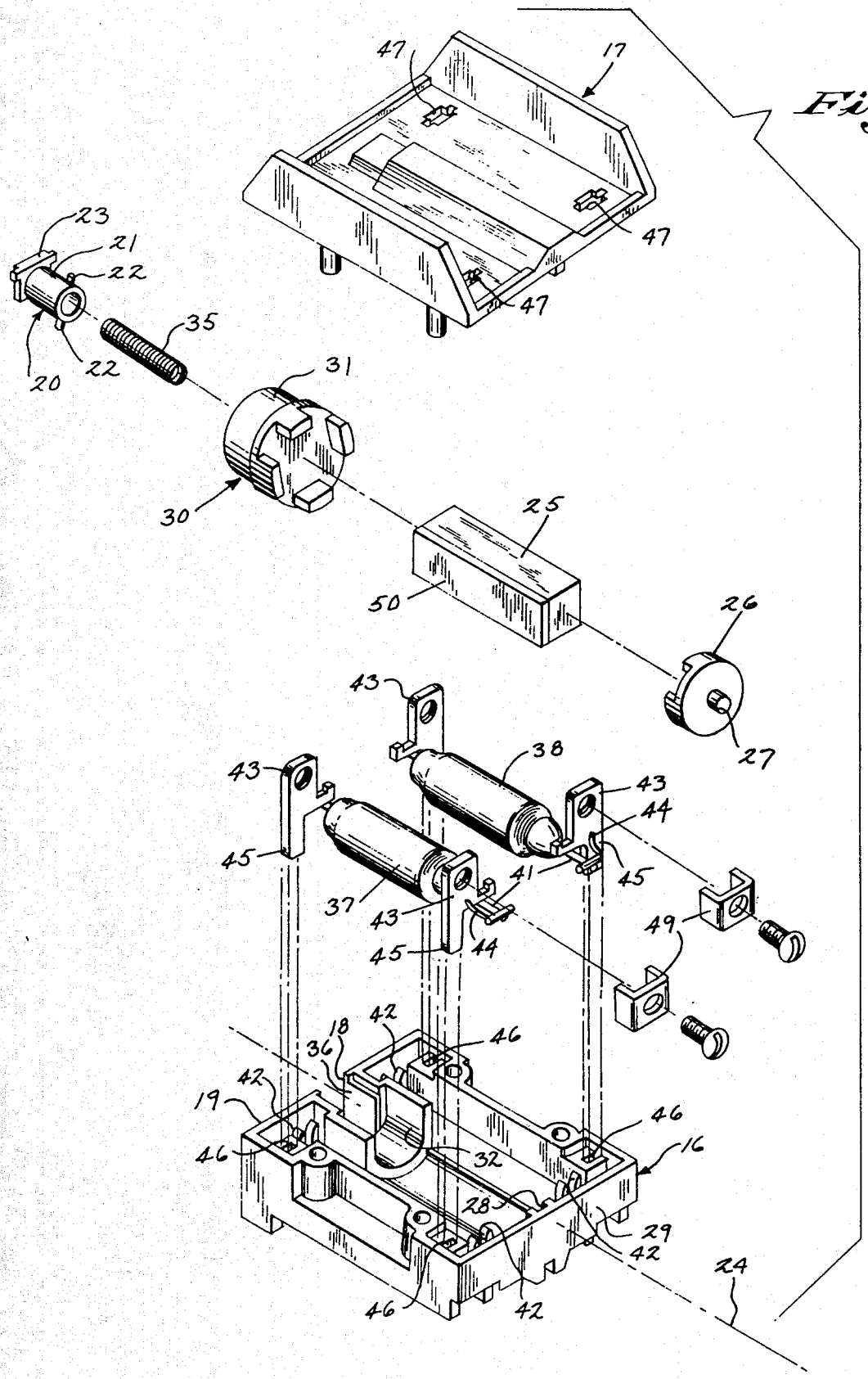
FIG. 3 is an exploded perspective view of a switch cartridge which forms part of the switch of FIG. 1.

Referring particularly to FIGS. 1, 2 and 3, the contact block section 2 is comprised of two identical switch cartridges 8*a* and 8*b*, each having a molded plastic housing comprised of a base portion 16 and a cover portion 17. The base 16 is substantially rectangular in shape and includes a rectangular opening 18 in its forward wall 19 through which a cam operator element 20 extends. The cam operator 20 includes a circular cylindrical body 21 which supports a pair of radially outward extending cam follower elements 22 at one end and a rectangular shaped bearing plate 23 at its other end. The bearing plate 23 engages the actuator element 11 on the actuator section 1 and is constrained to move linearly in response to the motion of the actuator element 11 along a switch axis 24 which extends through the center of the base 16.

Mounted for rotation about the switch axis 24 is a magnet 25. The magnet 25 is made of an oriented ferrite material and has a rectangular shape that is elongated in the direction of the switch axis 24. The magnet 25 is supported at its back end by a magnet holder 26 that cups the end of the magnet. The holder 26 is molded from a plastic material and includes a trunnion 27 which is rotatably received in a slot 28 formed on the back wall 29 of the base 16. The forward end of the magnet 25 is supported by a molded plastic cylindrical cam element 30 which cups its forward end. The cylindrical cam 30 includes a circular cylindrical outer surface 31 which is rotatably received in a channel 32 formed on the interior of the base 16 immediately rearward of the rectangular opening 18.

Referring particularly to FIG. 4, the cylindrical cam element 30 includes a central opening 33 which slidably receives the body 21 of the cam operator element 20. A pair of helical grooves 34 are formed around the interior surface of the cylindrical cam element 30, and each forms a pair of oppositely facing cam surfaces 48 which confine and guide the cam follower elements 22. A bias spring 35 is disposed within the hollow interior of the cam operator element 20 and extends rearward to engage the element 30 and urge the cam operator element 20 forward. As shown best in FIGS. 2 and 3, the cam operator element 20 is restrained against rotation by a pair of spaced walls 36 that slidably engage the two side edges of the bearing plate 23 and when the cam operator 20 is depressed by the actuator element 11 against the force of the bias spring 35, the cam follower elements 22 follow helical groove 34 and impart a rotary motion to the cylindrical cam 30. Consequently, when the cam operator 20 is depressed, the magnet 25 is rotated about the switch axis 24 in one direction, and when the cam operator 20 is released, the bias spring 35 translates the cam operator 20 forward and the cam follower elements 22 rotate the magnet 25 in the opposite direction back to its original position. By adjusting the slope of the cam surfaces 48, the amount of rotation of the magnet 25 for any given linear motion of the cam operator 20 can be precisely determined. In the preferred embodiment shown, the magnet 25 is rotated 180° about the central axis 24 when the pushbutton 9 is fully depressed.

Referring particularly to FIGS. 2 and 3, located immediately alongside the magnet 25 and disposed on opposite sides thereof are a pair of sealed switches 37 and 38. Each sealed switch 37 and 38 includes a pair of contacts 39 which are sealingly enclosed by an elongated glass enclosure 40. Each sealed switch 37 and 38 is supported by lead wires 41 which extend from each of its ends and which are received in clips 42 that are integrally molded to the base 16 and extend upward from its bottom. The lead wires 41 on each sealed switch 37 and 38 are also electrically connected to metallic terminals 43 by means of wires 44. The terminals 43 each include a leg portion 45 which extends into a mating cavity 46 that is integrally formed with the base 16. The terminals 43 extend upward through openings 47 in the cover 17 and are terminated with screw fasteners 49.

Referring to FIGS. 5*a*–5*d*, the magnet 25 is polarized to generate magnetic flux outward from the switch axis 24. By properly polarizing the magnet 25 and by the judicious use of metallic shields 50, the density of the magnetic flux coupled through the magnetic gap on each sealed switch 37 and 38 can be made to vary substantially as a function of the angular orientation of the magnet 25 about the switch axis 24. As is well known in the art, the contacts in a sealed switch close when the flux flowing across their magnetic gap reaches a selected magnitude, and they open when the flux drops below a preset level. Accordingly, the flux generated through the sealed switches 37 and 38 by the magnet 25 of the present invention rises above and drops below these operating points as the magnet 25 rotates about the switch axis 24 in response to the operation of the pushbutton 9.

Referring particularly to FIG. 5*a*, a magnet structure for providing a normally open and a normally closed mode of operation is shown in which a shield 50 made of steel is held in place on one of its four sides. The magnet 25 is polarized in the lateral direction as shown, that is perpendicular to the switch axis 24. A north and a south pole are formed on each of its sides facing the sealed switches 37 and 38. The flux generated in the direction of the switch 38 is shunted by the shield 50 and the switch contacts 39 therein are thus normally open. On the other hand, the flux generated outward from the other side face of the magnet 25 flows through the sealed switch 37 and normally closes the contacts 39 therein. By rotating the magnet 180° about the switch axis 24, the shield 50 is swung around and interposed between the magnet 25 and the sealed switch 37 and the flux density thus drops below the level necessary to maintain its contacts 39 closed. Similarly, the flux density in the sealed switch 38 rises above the pickup point of its contacts 39 during the rotation of the magnet 25 and they close. In other words, as the pushbutton 9 is depressed and released the magnet 25 and attached shield 50 is rotated back and forth 180° to operate the sealed switches 37 and 38 such that one is closed when the other is open.

Referring to FIG. *5b*, a magnet structure for providing a pair of normally open or normally closed contacts is shown in which the shield 50 is divided into two sections that each cover one half of one side of the magnet 25. The magnet 25 is again laterally polarized, but it includes a pair of north and a pair of south poles disposed alternately along each of its sides as shown. A shield 50 shunts the flux generated by a pair of these poles on each side, and as a result, flux is generated outward from the switch axis 24 toward the sealed switch 37 from one end of the magnet 25 and flux is generated outward toward the sealed switch 38 from the other end of the magnet 25. By using commercially available sealed switches having so-called "offset gaps" in which the contacts 39 are disposed closer to one end of their enclosure 40 than the other, both sealed switches 37 and 38 may be closed at the same time by reversing their orientations within the cartridge base 16 as shown. When the magnet 25 is rotated 180° from the normally closed position shown in FIG. *5b*, the shield sections 50 are swung into a blocking position to shunt the flux away from the contacts 39 on both sealed switches 37 and 38 and they open circuit. It should be apparent to those skilled in the art that by changing the positions of the shields 50 and the orientation of the sealed switches 37 and 38, a number of other modes of operation are possible with this magnet configuration.

Referring to FIG. *5c*, a magnet structure is shown for providing the same switch functions as provided in the structure of FIG. *5b*, but with a magnet rotation of only 90°. In this structure the magnet is laterally polarized as in the structure of FIG. *5a* and the magnetic flux pattern is substantially planar and extends outward in both directions from the switch axis 24 to normally close the sealed switches 37 and 38. When the magnet 25 is rotated 90° about the switch axis 24, the plane of the magnetic flux pattern is also rotated and the contacts 39 in both of the sealed switches 37 and 38 open. In other words, the flux density generated outwardly from the magnet 25 varies in magnitude sufficiently as the magnet 25 rotates about the axis 24 to operate the switches 37 and 38 without the use of a shield 50.

Although laterally polarized magnet configurations are preferred, a longitudinally polarized magnet structure is shown in FIG. *5d* in which the flux lines emanate from the ends of the magnet 25. The shield 50 is disposed over two adjacent sides of the magnet 25 and it extends past each of its ends. When in the position shown, magnetic flux extends outward from the switch axis 24 to close the contacts 39 in the sealed switch 37, but is shunted away from the sealed switch 38 by a portion of the shield 50. When the magnet 25 is rotated 90° to bring a portion of the shield 50 between it and the sealed switch 37, the sealed switch 38 closes and the sealed switch 37 opens.

It should be apparent to those skilled in the art that numerous variations from the preferred embodiment shown herein are possible without departing from the spirit of the invention. For example, although two switch cartridges each containing a pair of oppositely disposed sealed switches are contained in the contact block section of the preferred embodiment, a single switch cartridge containing more than two sealed switches is also possible. Also, by using bias magnets associated with the sealed switches other modes of operation, such as latching modes, can be achieved using the present invention.

We claim:

1. An actuator for magnetically operated switch contacts, the combination comprising:

a cam operator mounted for sliding motion along a switch axis;

a cam member mounted for rotary motion about said switch axis and being responsive to the sliding motion of said cam operator to rotate between first and second positions;

a magnet mounted to said cam member for rotation thereby about said switch axis between first and second positions, said magnet being polarized to generate magnetic flux which extends radially outward from said switch axis;

shunt means mounted for rotation with said magnet for blocking the radial extension of the generated magnetic flux over a sector; and means for mounting said magnetically operated switch contacts alongside said magnet for operation thereby as the magnet is rotated between its two positions.

2. The actuator as recited in claim 1 in which said magnet has a length along said switch axis which is substantially greater than its lateral dimensions and the mounting means includes a relatively long and slender enclosure which is aligned with its lengthwise dimension substantially parallel to the switch axis.

3. The actuator as recited in claim 2 in which the magnet is laterally polarized.

4. The actuator as recited in claim 1 in which second magnetically operated contacts are mounted alongside said magnet on the side opposite said switch axis.

5. In a cartridge having a base suitable for attachment to a switch actuator having a linearly operable actuator element, the combination comprising:

a magnet journaled to the base for rotation about a switch axis;

a sealed switch mounted to the base alongside said magnet with its lengthwise dimension aligned substantially parallel with the switch axis; and cam means fastened to one end of the magnet and coupled to the switch actuator, the cam means including a cam operator element which slides along the switch axis in response to the linear operation of the actuator element and a cylindrical cam element which rotates with the magnet about the switch axis, said cam operator being operable to impart rotary motion to the cylindrical cam element when it slides, and wherein the magnitude of the magnetic flux generated radially outward by said magnet through said sealed switch varies substantially as a function of the angular orientation of the magnet about said switch axis.

6. The cartridge as recited in claim 5 in which a second sealed switch is mounted to the base alongside the magnet on the side opposite the first sealed switch, and with its lengthwise dimensions also aligned substantially parallel with the switch axis.

7. The cartridge as recited in claim 5 in which the magnet is rotated between two positions by the operation of the cam means and in which a shield is fastened to the magnet to rotate therewith and is positioned to shunt a portion of the magnetic flux generated by the magnet away from the sealed switch when the magnet is in one of its two positions.

8. The cartridge as recited in claim 5 in which the cylindrical cam element has a circular opening into which a portion of the cam operator element is slidably and rotatably received, a helical groove is formed on the cylindrical cam element within said opening, and a cam follower element is formed on the cam operator element to ride in said groove.

* * * * *